US012042743B2

(12) United States Patent
Hakuta

(10) Patent No.: US 12,042,743 B2
(45) **Date of Patent: *Jul. 23, 2024**

(54) ROOM INSTALLATION INCLUDING ROOM AND MIRRORED BALLOONS, AND ASSOCIATED SYSTEM

(71) Applicant: SUMMIT ENTERTAINMENT VENTURES LLC, New York, NY (US)

(72) Inventor: David Kenzo Hakuta, New York, NY (US)

(73) Assignee: SUMMIT ENTERTAINMENT VENTURES LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/423,945

(22) Filed: Jan. 26, 2024

(65) Prior Publication Data

US 2024/0157261 A1 May 16, 2024

Related U.S. Application Data

(63) Continuation-in-part of application No. 18/111,893, filed on Feb. 21, 2023, which is a continuation of application No. 17/382,801, filed on Jul. 22, 2021, now Pat. No. 11,617,963.

(51) Int. Cl.
*A63H 27/10* (2006.01)
*A63J 13/00* (2006.01)

(52) U.S. Cl.
CPC ..... *A63H 27/10* (2013.01); *A63J 13/00* (2013.01); *A63H 2027/1008* (2013.01); *A63H 2027/1025* (2013.01); *A63H 2027/1041* (2013.01)

(58) Field of Classification Search
CPC ..... A63H 27/10; A63H 2027/1008; A63H 2027/1025; A63H 2027/1041; A63H 2027/1058; A63H 2027/1066; A63H 2027/1075
USPC ..... 446/220, 221, 222, 223, 224, 225, 226
See application file for complete search history.

(56) References Cited

U.S. PATENT DOCUMENTS 4,888,836 A * 12/1989 Calderwood ..... A47C 17/84 297/DIG. 3
4,931,028 A * 6/1990 Jaeger ..... A63H 30/04 244/30
5,031,908 A * 7/1991 Spector ..... A63F 9/305 273/458
5,080,625 A * 1/1992 Huffhines ..... A63F 9/02 446/225
5,227,922 A * 7/1993 Boos ..... G02B 17/02 359/857

(Continued)

*Primary Examiner* — Joseph B Baldori
(74) *Attorney, Agent, or Firm* — Greenberg Traurig, LLP

(57) ABSTRACT

A room installation including: a room having at least one wall, a ceiling, and a floor, each of which is at least partially covered by a mirrored surface; at least one transparent window to permit ambient light into the room; and a first plurality of mirrored balloons arranged within the room, and filled with a mixture of helium and another gas, the mixture configured to float the balloons of the first plurality of balloons substantially within a middle height of the room; and a plurality of vents to circulate and move the balloons of the first plurality of balloons in a designated pattern within the room.

20 Claims, 8 Drawing Sheets

(56) References Cited

U.S. PATENT DOCUMENTS 5,381,779 A * 1/1995 Shelton ..... A63H 37/00 244/31
5,727,700 A * 3/1998 Digney ..... A47F 5/0892 211/119
5,743,786 A * 4/1998 Lindsey ..... A63H 33/048 446/221
5,765,831 A * 6/1998 Huffhines ..... A63H 27/10 273/DIG. 30
5,797,783 A * 8/1998 Harris ..... A63H 27/10 40/124.05
5,893,790 A * 4/1999 Montgomery ..... A63H 27/10 446/225
5,906,335 A * 5/1999 Thompson ..... F02B 75/34 244/92
6,019,660 A * 2/2000 Luciano ..... A63H 27/10 446/223
6,149,495 A * 11/2000 Austin ..... A63J 5/028 406/102
6,238,067 B1 * 5/2001 Hirsch ..... F21V 23/04 362/399
7,581,835 B1 * 9/2009 Walker ..... G03B 21/00 372/15
8,303,367 B2 * 11/2012 English ..... A63H 27/10 244/31
9,480,930 B2 * 11/2016 Bergmann ..... A63H 27/10
10,717,017 B2 * 7/2020 Publicover ..... A63H 27/10
10,843,098 B1 * 11/2020 Simonsen ..... A63H 27/10
10,994,217 B2 * 5/2021 Lopez Diaz ..... A63H 27/10
11,156,353 B2 * 10/2021 Diamonds ..... F21L 14/00
11,316,470 B2 * 4/2022 Unal ..... H02S 40/425
11,422,454 B1 * 8/2022 Yett ..... G03B 21/562
11,617,963 B2 * 4/2023 Hakuta ..... A63J 13/00 446/220

* cited by examiner

ROOM INSTALLATION INCLUDING ROOM AND MIRRORED BALLOONS, AND ASSOCIATED SYSTEM

CROSS-REFERENCE TO RELATED APPLICATIONS

The present application is a continuation-in-part of U.S. application Ser. No. 18/111,893, titled "FLOATING OBJECTS AND METHOD MAINTAINING SAID OBJECTS IN CONTAINED ENVIRONMENT," filed Feb. 21, 2023, which is a continuation of U.S. application Ser. No. 17/382,801, titled "FLOATING OBJECTS AND METHOD FOR MAINTAINING SAID OBJECTS IN CONTAINED ENVIRONMENT," filed Jul. 22, 2021, issued as U.S. Pat. No. 11,617,963, the disclosures of which are incorporated by reference herein in their entireties.

FIELD

The present invention relates to floating objects in a contained and/or mirrored, environment. More specifically, the present invention relates to inflatable objects floating in air, as well as a system and/or method for maintaining and/or circulating the objects in a contained, mirrored environment.

BACKGROUND

It is well known to use helium to inflate balloons so that the balloons float in air, because helium is less dense than air. However, when outside, a helium-filled balloon tends to be filled to the extent that the balloon float upwards until the balloon reaches an elevation at which air in the atmosphere is of equal density than that of the balloon. In a closed environment, such as a room, helium-filled balloons rise to the ceiling and remain there.

In some instances, to have a helium-filled balloon remain at mid-room height where the balloon does not touch the ceiling, a string may be tied to the balloon, and the string may be attached to a weight. However, the string is unsightly, and the balloon also remains generally stationary within the room, such that the balloon can only be moved around the room manually.

Helium-filled balloons may be used to fill rooms or add atmosphere to the décor. However, the balloons may not directly reflect the décor of the room or add to the perception of the space itself. That is, the balloons are usually independent from the ambience or appearance of the walls of the room itself.

SUMMARY

The Claims, rather than the Summary, define covered embodiments of the present invention. The Summary is a high-level overview of various aspects of the invention, and introduces concepts that are further described in the Detailed Description below. The Summary is not intended to identify key or essential features of the claimed subject matter, and also is not intended to be used in isolation to determine the scope of the claimed subject matter. Instead, the claimed subject matter should be understood by reference to appropriate portions of the Specification and drawings, as well as to each claim.

In some embodiments, the present invention provides floating objects, such as balloons that float and move around a confined space, neither sinking fully to and contacting the floor, nor raising up to and contacting the ceiling. In some embodiments, the floating objects can be of a mirrored or reflective nature, to divert light paths passing though the center of a room or other event space in which the balloons are located. In some embodiments, the floating objects include one or more mirrored balloons. In some embodiments, the arrangement of mirrored balloons may be combined with mirrored wall surface, to produce a desired visual effect. In some embodiments, an open wall of the room allows ambient light from outside of the room to enter the room, such that the light reflects off of the walls and/or the balloons, to create a desired, dynamic, visual effect.

In some embodiments, the present invention provides an air flow management system and/or method to contain the floating objects within a given space, such as a room, and/or to move the floating objects around the space to give the illusion of self-propulsion. In some embodiments, the mirrored balloons move within the room in a manner so as to constantly change the interaction between themselves and the mirrored walls, to produce a dynamic visual effect.

In some embodiments, a series of lights, providing a constantly changing pattern and/or on a steady pattern, can be added to the mirrored room, so that the pattern reflects off of the mirrored walls and/or the mirrored balloons.

In some embodiments, the present invention provides for an installation within a room having one or more walls, a ceiling, and/or floor, at least one of which is at least partially covered in a mirrored surface. In some embodiments, at least one window allows ambient light into the room. In some embodiments, a plurality of mirrored balloons are arranged within the room, and are filled with helium, to float substantially at a middle height of the room installation.

In some embodiments, one or more of the balloons are made of polyethylene terephthalate. In some embodiments, two or more of the balloons are of different sizes. In some embodiments, one of more of the balloons are weighted, such as with but not limited to a latex/polymer preservative of water, polyvinyl alcohol, and dextrose monohydrate. In some embodiments, the amount of preservative is sufficient to prevent the helium-filled balloons from rising to the ceiling, but does not cause the balloons to sink to the floor. In some embodiments, the room has at least one air vent for circulating and/or moving the balloons within the room.

In some embodiments, the present invention provides a room installation comprising: a room comprising at least one wall, a ceiling, and a floor, each of which is at least partially covered by a mirrored surface; at least one transparent window configured to permit ambient light into the room; a first plurality of mirrored balloons arranged within the room, and filled with a mixture of helium and another gas, the mixture configured to float the mirrored balloons of the first plurality of mirrored balloons substantially within a middle height of the room; and a plurality of vents configured to circulate and move the mirrored balloons of the first plurality of mirrored balloons in a designated pattern within the room.

In some embodiments, at least one of the at least one wall, the ceiling, or the floor is entirely covered with mirrors.

In some embodiments, the at least one wall comprises two walls.

In some embodiments, the at least one wall comprises at least three walls.

In some embodiments, the plurality of vents comprises four vents.

In some embodiments, the designated pattern is a circular pattern.

In some embodiments, the designated pattern is a non-circular pattern.

In some embodiments, the installation further comprises a second plurality of mirrored balloons, wherein the mirrored balloons of the second plurality of mirrored balloons contact at least one the ceiling or the floor.

In some embodiments, the room installation further comprises a second plurality of mirrored balloons, wherein the mirrored balloons of the second plurality of mirrored balloons contact the ceiling; and a third plurality of mirrored balloons, wherein the mirrored balloons of the third plurality of mirrored balloons contact the floor.

In some embodiments, the mirrored balloons of the first plurality of mirrored balloons float at at least two elevations within the room.

In some embodiments, the present invention provides a system, comprising: a room, comprising: at least one wall at least partially covered with a mirrored surface, a ceiling at least partially covered with a mirrored surface, a floor at least partially covered with a mirrored surface, at least one window configured to allow light from outside of the room into the room, and at least one vent; and a first plurality of balloons, wherein each of the balloons of the first plurality of balloons is at least partially covered with a mirrored surface, wherein each of the balloons of the first plurality of balloons is positioned within the room, wherein each of the balloons of the first plurality of balloons contains a mixture of helium and another gas, such that each of the balloons of the first plurality of balloons floats at a middle height within the room out of contact with the ceiling and the floor, wherein the at least one vent is configured direct air toward at least one of the balloons of the first plurality of balloons to move the at least one of the balloons in a predetermined pattern.

In some embodiments, at least one of the at least one wall, the ceiling, or the floor is entirely covered with mirrors.

In some embodiments, the at least one wall comprises two walls.

In some embodiments, the at least one wall comprises at least three walls.

In some embodiments, the at least one vent comprises four vents.

In some embodiments, the predetermined pattern is a circular pattern.

In some embodiments, the predetermined pattern is a non-circular pattern.

In some embodiments, the system further comprises a second plurality of balloons, wherein the balloons of the second plurality of balloons contact at least one the ceiling or the floor.

In some embodiments, the system further comprises a second plurality of balloons, wherein the balloons of the second plurality of balloons contact the ceiling; and a third plurality of balloons, wherein the balloons of the third plurality of balloons contact the floor.

In some embodiments, the balloons of the first plurality of balloons float at at least two elevations within the room.

BRIEF DESCRIPTION OF DRAWINGS

This section refers to the drawings that form a part of this disclosure, and which illustrate some of the embodiments of structure, materials, and/or methods of the present invention described herein.

DETAILED DESCRIPTION

In addition to the benefits and improvements that the Specification discloses, other objects and advantages that the Specification provides will become apparent from the following description taken in conjunction with the accompanying figures. Although the description discloses and describes detailed embodiments of the present disclosure, the disclosed embodiments are merely illustrative of the disclosure that may be embodied in various forms. In addition, each of the examples given regarding the various embodiments of the disclosure are intended to be illustrative, and not restrictive.

Figure 1:
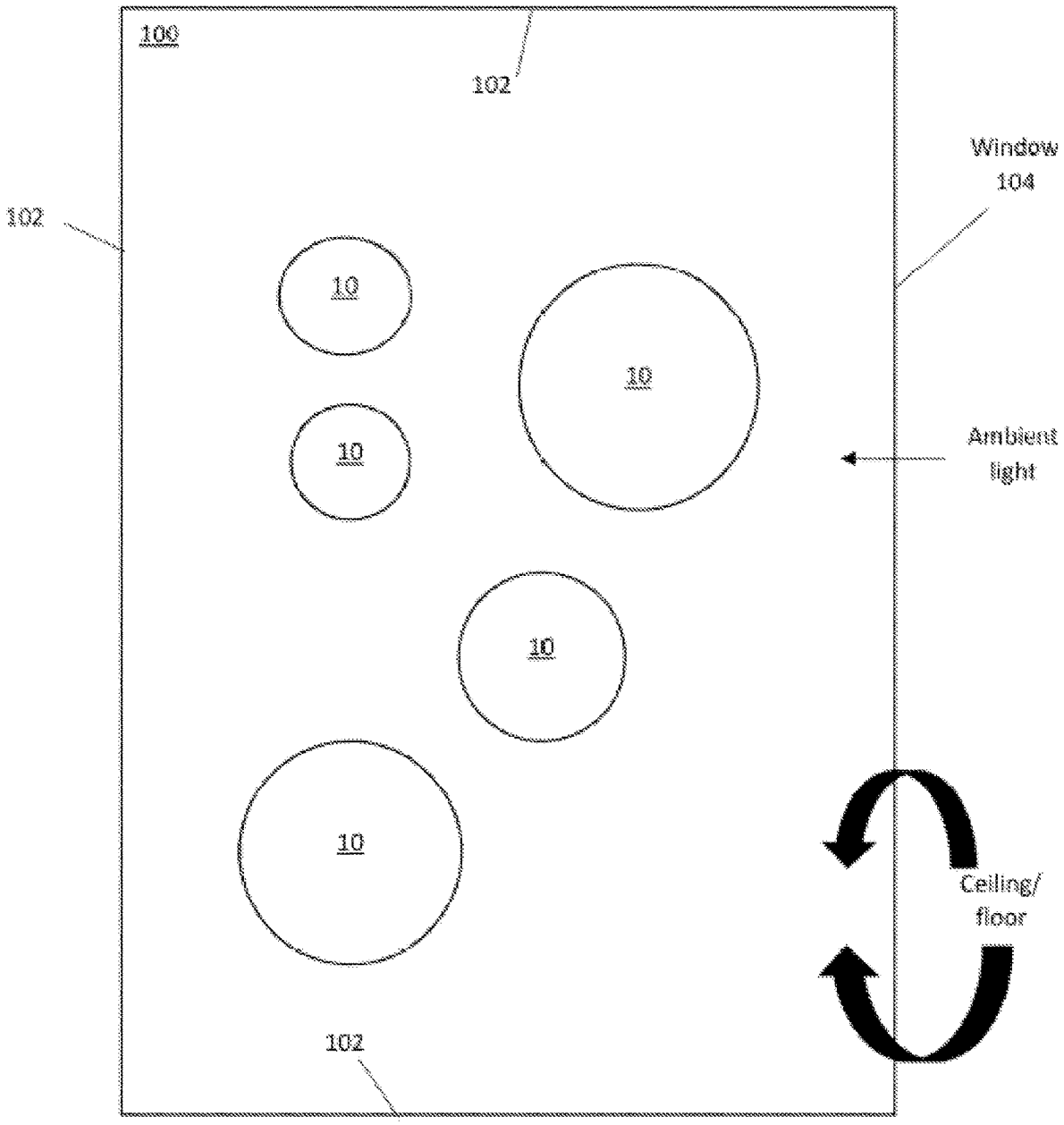
FIG. 1 is a schematic view of a room filled with balloons, in accordance with some embodiments of the invention.

With reference to FIG. 1, in some embodiments, a series of floating objects, such as inflated balloons 10, are within a room 100. In some embodiments, the room 100 includes at least one mirror 102, which has a reflective surface. In some embodiments, one or more walls, a floor, and/or a ceiling is at least partially covered with one or more of the mirrors 102. In some embodiments, one or more walls, a floor, and/or a ceiling is substantially completely covered with one or more of the mirrors 102. In some embodiments, one or more walls, a floor, and/or a ceiling is completely covered with one or more of the mirrors 102. In some embodiments, one or more of the inflated balloons 10 have a mirrored (e.g., reflective) surface. In some embodiments, one of more of the surfaces of the room 100 and/or one or more of the balloons 10 do not include mirrored or reflective surfaces.

In some embodiments, the room 100 includes a window 104, and all of the other surfaces of the room 100 are at least partially covered by the mirrors 102. In some embodiments, the window 104 is a transparent window, which allows light from outside of the room 100 to enter the room 100. In some embodiments, the room 100 includes the window 104, and all of the other surfaces of the room 100 are substantially completely covered by the mirrors 102. In some embodiments, one or more surfaces of the room 100 includes lights 300, as discussed in more detail below.

In some embodiments, the window 104 allows the room 100 to be filled with ambient light and imagery that is captured and reflected off of the mirrors 102 of the room 100 and/or the mirrored surfaces of the balloons 10. In some embodiments, for example, placement of room 100 in a city setting captures an image or skyline of the city through window 104 and reflects the image off of the mirrors 102 of the room 100 and/or the mirrored surfaces of the balloons 10 in a repeating pattern, as the light continuously bounces between and reflects off of the walls, floor, and/or ceiling of the room 100, and/or the balloons 10. In some embodiments, the pattern is a designated pattern. In some embodiments, the pattern is a predetermined pattern. In some embodiments, the room 100 is placed in a different setting, such as but not limited to an ocean setting (e.g., on a cruise ship) or in a nature setting (e.g., in a forest canopy or pastoral setting), and the room 100 captures the ambient light patterns from the scenery and reflects the light off of the mirrors 102 of the room 100 and/or the mirrored surfaces of the balloons 10.

In some embodiments, as shown in FIG. 1, a plurality of the balloons 10 of various diameters are filled with a gas such as helium, to allow the balloons 10 to float. In some embodiments, the balloons 10 may be fitted with one or more weights that counter-balance the helium, thereby allowing the balloons 10 to float within the middle of room 100—e.g., such that the balloons 10 neither fall to and contact the floor, nor rise to and contact the ceiling of the room 100. In some embodiments, the balloons 10 are filled with helium and weighted with a weight so that balloon 10 floats within the middle of the room 100.

In some embodiments, the balloons 10 are preferably made of reflective Mylar™ (e.g., polyethylene terephthalate). In some embodiments, the balloons 10 are several difference sizes as shown in FIG. 1. In some embodiments, the sizes can include, but are not limited to, Mylar Size 1 (7" inflated); Mylar Size 2 (9" inflated); Mylar Size 3 (11" inflated); Mylar Size 4 (14" inflated); Mylar Size 5 (16" inflated); and/or Mylar Size 6 (22" inflated). In some embodiments, the sizes can include, but are not limited to 8 inches, 12 inches, 18 inches, and/or 24 inches. In some embodiments, one or more of the balloons are round in shape. In some embodiments, one or more of the balloons 10 are substantially round in shape. In some embodiments, one or more of the balloons 10 is a shape other than round.

Figure 2A:
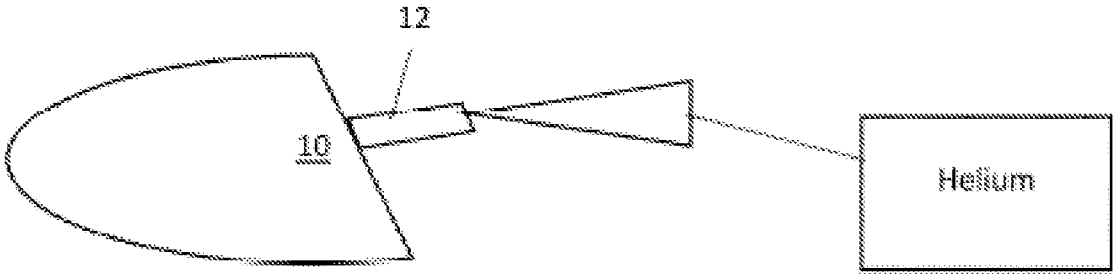
FIGS. 2A and 2B are schematic views of a balloon during an inflation process and a sealing process, in accordance with some embodiments of the invention.
Figure 2B:
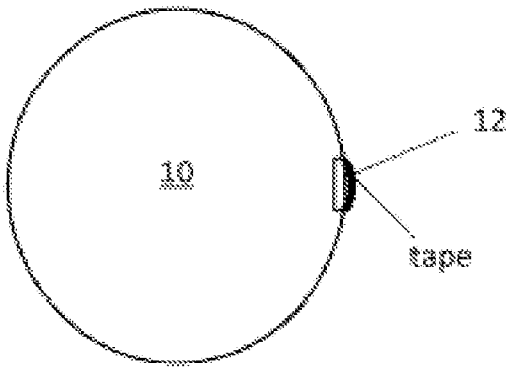

With reference to FIG. 2A, in some embodiments, as part of a filling process, one or more of the balloons 10 are filled and sealed by attaching a nozzle extension 12 of the balloon 10 to a nozzle of a helium tank. In some embodiments, the balloon 10 is filled until its seams flatten out (e.g., the balloon 10 achieves a completely filled state) and then tape, such as but not limited to shipping tape, can be used to secure and/or flatten the inflation point at nozzle extension 12, thereby sealing in the helium and closing the balloon 10. FIG. 2B shows the balloon 10 when the balloon 10 is inflated with the nozzle extension 12 closed and taped, in accordance with some embodiments.

Figure 3:
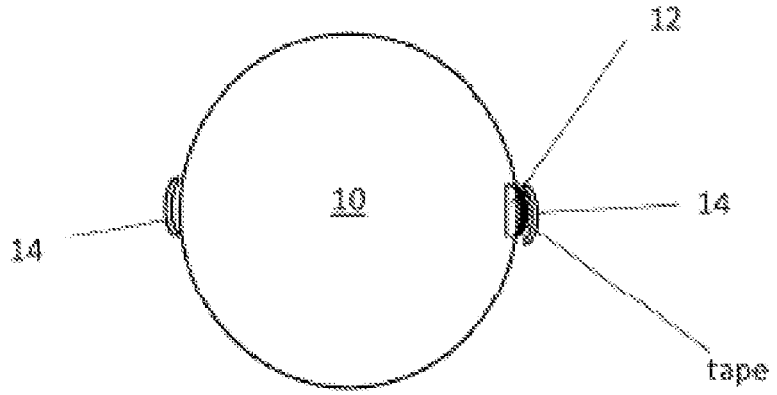
FIGS. 3 and 4 are schematic views of a completely filled balloon with weights, pads and patches on the balloon, in accordance with some embodiments of the invention.

In some embodiments, after filling of the balloon 10, a weight 14 may be attached over the closed nozzle extension 12. In some embodiments, the weight 14 is in the form of a washer. In some embodiments, a second weight 14 may be placed on the opposite side of balloon 10 to which the weight 14 is attached, for balance. FIG. 3 shows two weights 14 on either side of balloon 10—one of the weights 14 over closed nozzle extension 12, and the other one of the weights 14 positioned on the side of the balloon opposite the nozzle extension 12, in accordance with some embodiments. In some embodiments, the weights 14 can be of different sizes, shapes, configurations, and weights. For example, in some embodiments, the weights 14 are larger and/or heavier for larger ones of the balloons 10. In some embodiments, the placement of weight 14 over the nozzle extension 12 helps cover the nozzle extension 12 for aesthetic purposes, and the use of diametrically opposed weights 14 helps balance the balloons 10 as the balloons 10 float and rotate in the air in the room 100. In some embodiments, when only a single weight 14 is used, the weight 14 is at the bottom of the balloon 10. In some embodiments, when the balloon 10 includes multiple weights 14, the balloons 10 move around the room 100 in a spinning motion and react more "naturally" as a floating object.

In some embodiments, to maintain a mirrored surface on the outside of the balloon and to match the mirrored outer surface on the rest of the balloon 10, a pad 16 and a patch 18 are fitted over the weights 14. In some embodiments, the patch 18 is a reflective material. In some embodiments, the patch 18 is a Mylar patch. In some embodiments, the pad 16 and patch 18 are two separate items, while in some embodiments the pad 16 and the patch 18 are a single element. In some embodiments, the pad 16 reduces chipping of the mirrors 102 in the room 100 as the balloon 10 moves around and the weights 14 occasionally contact the mirrors 102.

Figure 4:
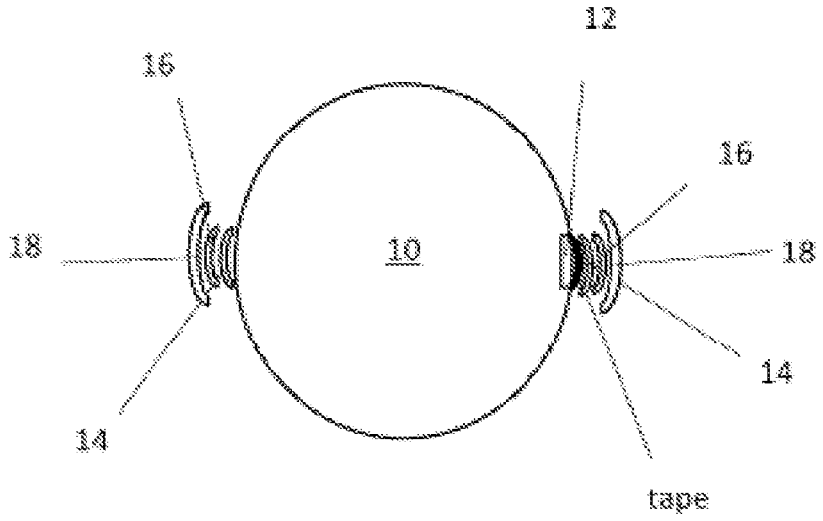
Figure 5:
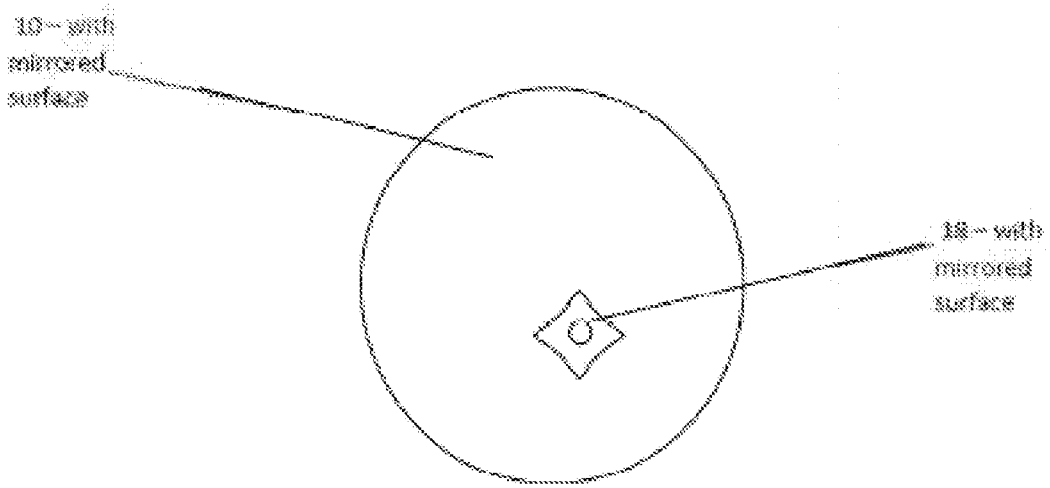
FIG. 5 is a schematic view of an inflated and patched balloon, in accordance with some embodiments of the invention.

In accordance with some embodiments, FIG. 4 shows the balloon 10 inflated, with the weights 14 as well as the pads 16 and the patches 18. Although FIG. 4 is an expanded view, in some embodiments, the weight 14, the pad 16, and the patch 18 essentially provide a smooth and/or continuous surface with the outside surface of the balloon 10, to maintain an essentially continuous mirrored outer surface, such as, for example, as FIG. shows.

In some embodiments, in place of and/or in addition to use of the weights 14, prior to filling the balloon 10, the balloons 10 may be filled with a preservative. In some embodiments, the preservative is a latex/polymer preservative such as but not limited to HiFloat™ (e.g., a mixture of water, polyvinyl alcohol, and dextrose monohydrate). In some embodiments, the preservative helps seal the inside of the balloons 10 so as to retain the helium with the interior of the balloons 10.

Figure 6:
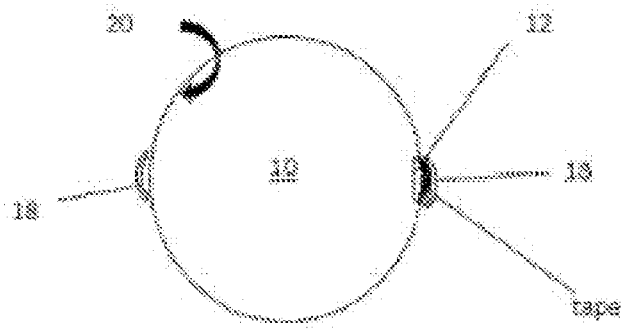
FIG. 6 is a schematic view of an inflated and patched balloon with a sealant, in accordance with some embodiments of the invention.

With reference to FIG. 6, in some embodiments, the balloon 10 includes a coating spread on the inside surface of the balloon 10, with the patch 18 used over the nozzle extension 12. In some embodiments, the coating 20 helps to weigh the balloon 10, so that the balloon 10 floats at a middle height within the room 100. In some embodiments, the coating is a latex/polymer coating. In some embodiments, the amount of the coating used can be adjusted depending on the size and/or volume of the balloon 10 in order to allow the balloon 10 to float in the middle of the room 100 when filled with helium. Thus, in some embodiments, the helium otherwise would cause the balloon 10 to rise and contact the ceiling of the room 100, however the weight of the coating 20 causes the balloon 10 to float at the middle height. In some embodiments, the amount of the coating depends on the size and/or volume of the balloon 10, and/or is based on expected effects of temperatures and/or elevation where the room 100 is located.

Figure 7:
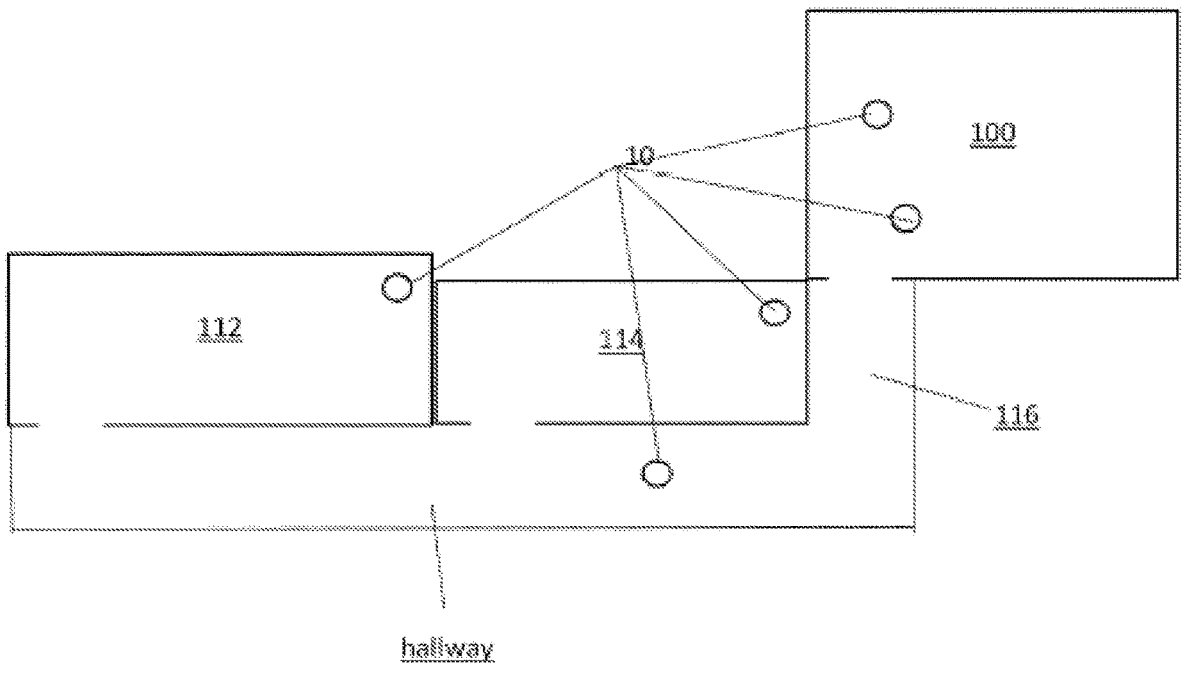
FIG. 7 is a schematic view of a room installation, in accordance with some embodiments of the invention.

As shown in FIG. 7, in some embodiments, the room 100 in which the balloons 10 are installed is associated with and/or connected to a filling room 112, a staging or holding room 114, and/or an entrance corridor 116. In some embodiments, entrance corridor 116 exits into the room 100 where the balloons 10 float, as described and as shown in FIG. 1. In some embodiments, the filling room 112 has equipment to fill and seal the balloons 10, input the coating 20, attach the weights 14, and/or attach the patches 18. In some embodiments, after being filled, the balloons 10 are staged and held in the holding room 114 which acts as a reserve are for the balloons 10, so that operators can control the number of the balloons 10 in the room 100. In some embodiments, when the balloons 10 are to be added to the room 100, the balloons 10 are retrieved and proceeded down the entrance corridor 116 into the room 100.

In some embodiments, there is a mechanism for providing the balloons 10 that are staged in the holding room 114, for delivery into the room 100. In some embodiments, the mechanism includes an opening between the holding room 114 and the room 110. In some embodiments, the mechanism includes a doorway. In some embodiments, the mechanism includes a hatch. In some embodiments, the hatch is opened manually. In some embodiments, the hatch is opened automatically. In some embodiments, the mechanism includes a machine or other apparatus, such as to open the hatch.

In some embodiments, the room 100 is provided with one or more vents 200. In some embodiments, the vents 200 are used move the balloons 10 in a pattern within the room 100. In some embodiments, the pattern is a regular pattern. In some embodiments, the pattern is a circular pattern. In some embodiments, the pattern is a non-circular pattern. In some embodiments, the pattern is an irregular pattern. In some embodiments, the pattern changes based on an interaction between at least one individual in the room 100 and one or more of the balloons 10. As discussed, in some embodiments, the balloons 10 are filled and weighted to float essentially at middle height—that is, in the middle of the room without rising all the way to and contacting the ceiling, and without falling to and contacting the floor. In some embodiments, the vents 200 can be located around the room 100 to direct movement of the balloons in a single direction or in a pattern. In some embodiments, the vents 200 direct movement of one or more of the balloons 10 in a circular pattern. In some embodiments, the vents 200 direct movement of one or more of the balloons 10 in a non-circular pattern.

In some embodiments, one or more fans may be used in place of one or more of the vents 200. In some embodiments, the room 100 omits fans. In some embodiments, the room 100 omits vents 200. In some embodiments, the room 100 includes at least one fan and at least one vent 200. In some embodiments, one or more vents 200 and/or one or more fans are positioned to reduce movement of one or more of the balloons 10 out of the room 100, such as out of a door into which individuals enter and/or exit the room 100.

Figure 8:
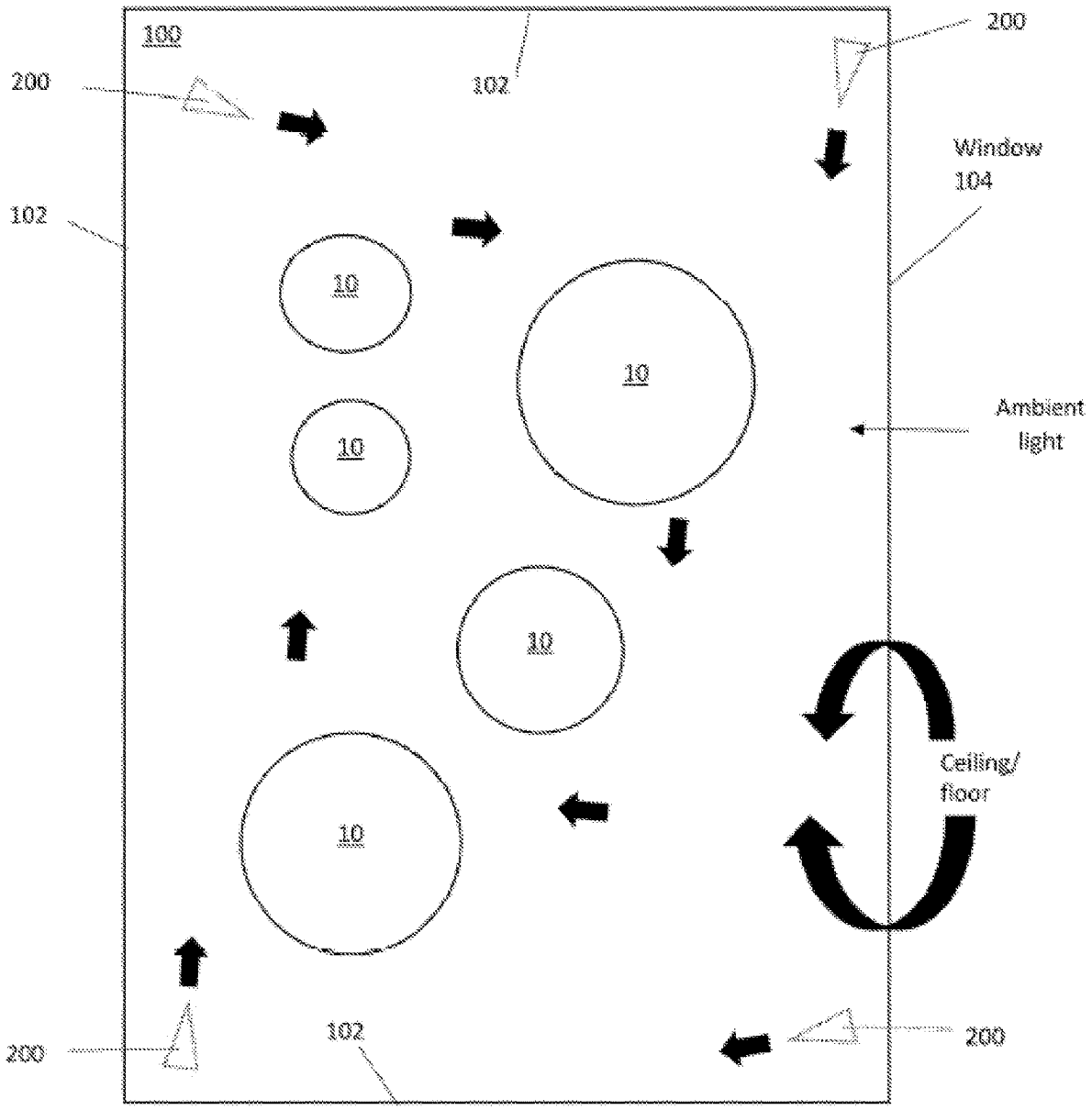
FIG. 8 is a schematic view of a room filled with balloons and vented movement of the balloons within the room, in accordance with some embodiments of the invention.
Figure 9:
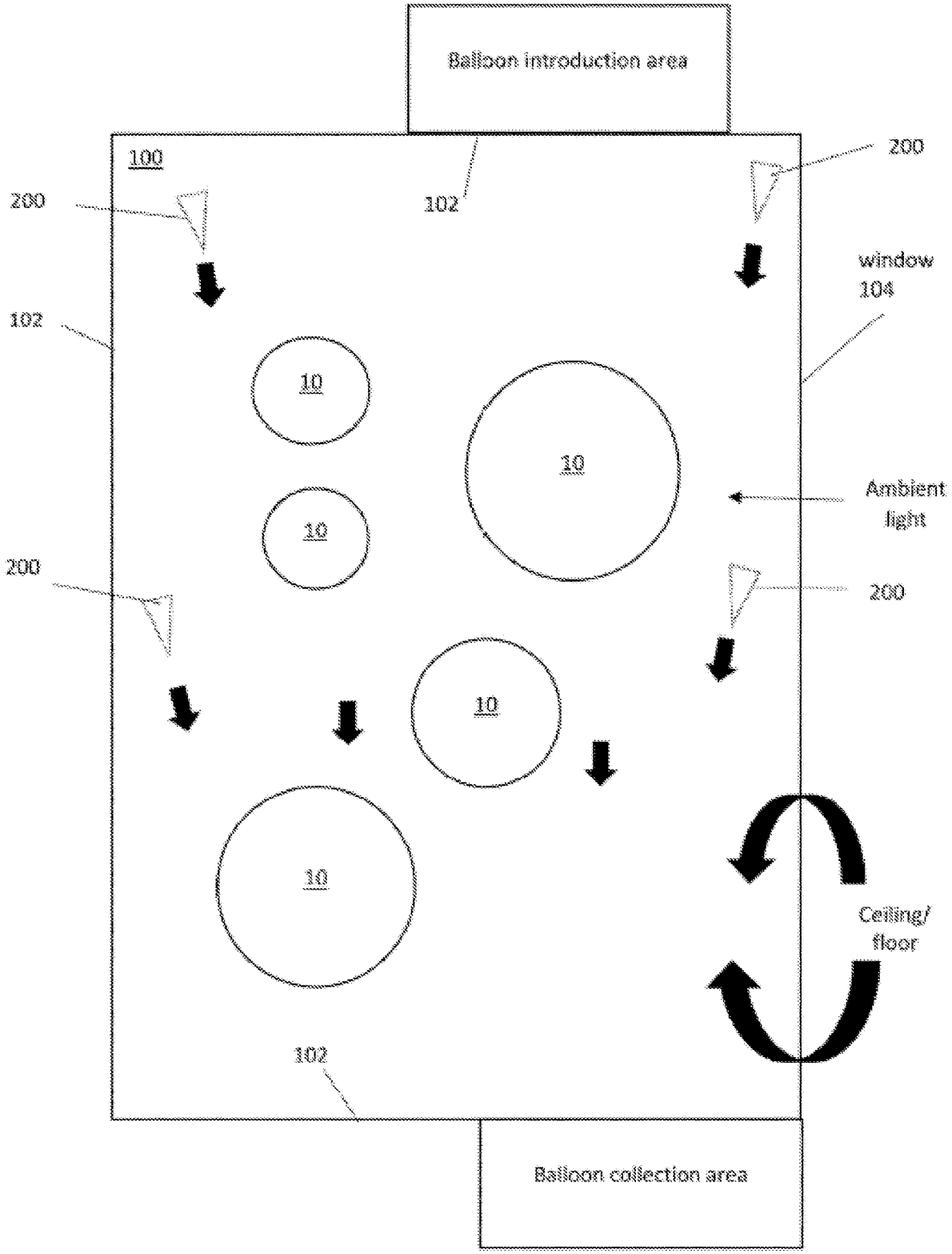
FIG. 9 is a schematic view of a room filled with balloons and vented movement of the balloons within the room, in accordance with some embodiments of the invention.

FIG. 8 shows the room 100 with four of the vents 200 located on different sides of the room 100, either near the ceiling or floor to move the balloons 10 in a pattern, in accordance with some embodiments of the invention. FIG. 9 shows the room 100 with four of the vents 200 located on different sides of the room 100, either near the ceiling or floor, to move balloon 10 in a single direction, such as from one side to another side of the room 100, in accordance with some embodiments of the invention. It is to be understood that there are various options for locations of the vents 200, and/or various patterns in which the balloons 10 may be moved within the room 100. In some embodiments, an air speed of air flowing out of the vents 200 moves the balloons 10 in any one of a slow, medium, and/or fast pattern, so that an interaction between mirrored surfaces of the balloons 10 and/or mirrors 102 of the room 100, and ambient light from the window 104, provides a changing visual landscape. In some embodiments, individuals walking within the room 100 experience a changing light dynamic as the ambient light enters through the window 104 and then bounces off of the mirrors 102 of the room 100, as well as the mirrored surfaces of the balloons 10, which are moving, in a dynamic experience. In some embodiments, the vents 200 may be configured as part of an HVAC system in the room 100. In some embodiments, the vents 200 may be provided for movement of the balloons 10. In some embodiments, the vents 200 may be from an independent air moving system solely for moving the balloons 10.

Figure 10:
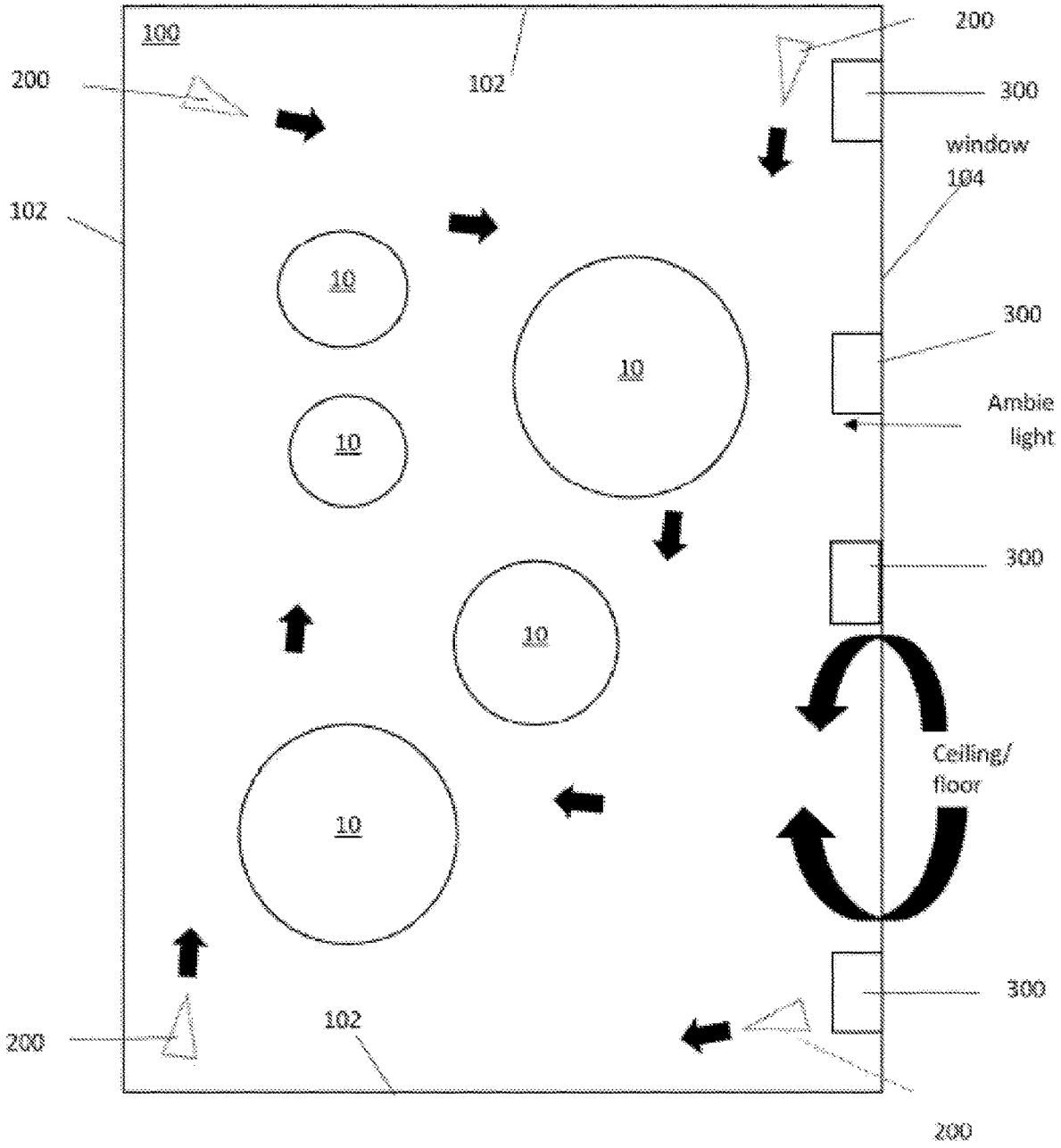
FIG. 10 is a schematic view of a room filled with balloons and vented movement of the balloons within the room, in accordance with some embodiments of the invention.

With reference to FIG. 10, in some embodiments, the room 100 has the lights 300, which provide an additional visual aspect that interacts with the mirrors 102 of the room 100, the mirrored surfaces of the balloons 10, and/or the ambient light entering through the window 104. As shown in FIG. 10, in some embodiments, the lights 300 are vertical column lights (e.g., such as lights extending between the floor and the ceiling of the room 100). In some embodiments, the lights 300 are positioned across the window 104 of the room 100, so that the lights 300 interact with the ambient light entering the room 100. In some embodiments, the lights are colored lights and/or white lights. In some embodiments, the lights 300 are steady lights and/or sequentially-flashing lights. In some embodiments, the lights 300 reflect off of the mirrors 102 of the room 100 and/or the mirrored surfaces of the balloons 10, thereby providing an additional dimension to the light dynamic within the room 100.

In some embodiments, one or more of the balloons 10 may include a mixture of helium and at least one other fluid, such that the one or more of the balloons 10 floats at the middle height (e.g., floats at an elevation within the room at which the balloon 10 does not touch or contact the ceiling, and/or does not touch or contact the floor), such as without the use of the weights 14. In some embodiments, the fluid includes a gas. In some embodiments, the gas includes air. In some embodiments, the gas includes air and another gas. In some embodiments, the gas includes a gas other than air. In some embodiments, one or more of the balloons 10 includes the mixture and one or more of the weights 14. In some embodiments, one or more of the balloons 10 includes the mixture and two of the weights 14. In some embodiments, one or more of the balloons includes the mixture and omits the weights 14.

In an example of the filling method to obtain balloons that float at various heights in the room (with or without the need for additional weights), the following general procedure is employed. First, a plan of the balloon distribution is mapped by determining the desired heights and number of balloons at each layer. Consider ceiling height, visual effect, and weight limitations. Second, the gas mixture is selected.—different gases have different densities and affect buoyancy. Suitable gas options include, but are not limited to, air (least buoyant), oxygen (slightly more buoyant than air), carbon dioxide (more buoyant than aft) and then helium. Third, the gas mixture is pumped into each balloon with the desired proportions of helium and other gas (e.g., 1 cup helium 1 cup air). In one example, a mixing pump may be used to achieve the desires ratio. Fourth, the balloons are inflated by attaching the nozzle to the gas portion of the balloon and opening the nozzle valve to slowly fill the balloon, monitoring its size. In one example, a slightly underinflated balloon may have longer float time. In another example, each balloon is marked with the gas mixture for clear identification and easier height adjustment later. In another embodiment, strings or fishing lines may be attached to adjust buoyancy. The balloons may be monitored over time, as helium gradually diffuses out, altering their float height.

In some embodiments, the weight of the one or more weights 14, and/or a composition of the mixture, which keeps the balloons 10 at the middle height, is dependent on a season, a time of the year, a time of the day, an atmospheric condition within the room 100, an amount of ambient light in the room 100, an amount of artificial light in the room 100, an air temperature within the room 100, a humidity in the room 100, an elevation of the room 100, and/or a color of the balloon 10.

In some embodiments, the weight of the one or more weights 14, and/or the composition of the mixture, keeps at least one of the balloons 10 at an elevation within the middle height that is different than an elevation within the middle height of one or more others of the balloons 10. In some embodiments, the different elevations include two elevations. In some embodiments, the different elevations include three elevations. In some embodiments, the different elevations include four elevations. In some embodiments, the different elevations include five elevations. In some embodiments, the different elevations include more than five elevations.

In some embodiments, at least one shape, size, color, material, and/or other property of one or more of the balloons 10 corresponds to an event, a day, a time of day, a holiday, and/or an identity of a visitor to the room 100.

In some embodiments, the room 100 is scented with one or more scents. In some embodiments, the scent corresponds to an event, a day, a time of day, a holiday, and/or an identity of a visitor to the room 100.

In some embodiments, one or more of the balloons 10 is in contact with and touches the floor of the room 100. In some embodiments, one or more of the balloons 10 is in contact with and touches the ceiling of the room 100.

In some embodiments, the lights 300 projects one or more patterns, colors, intensities, and/or brightness, such as based on an event, a day, a time of day, a holiday, and/or an identity of a visitor to the room 100.

Variations, modifications, and alterations to embodiments of the present disclosure described above will make themselves apparent to those skilled in the art. All such variations, modifications, alterations and the like are intended to fall within the spirit and scope of the present disclosure, limited solely by the appended claims. In some embodiments, one or more of the balloons 10 are filled entirely with air. In some embodiments, one or more of the balloons 10 are filled substantially entirely with air. In some embodiments, one or more of the balloons 10 are filled entirely with helium. In some embodiments, one or more of the balloons 10 are filled substantially entirely with helium.

While several embodiments of the present disclosure have been described, it is understood that these embodiments are illustrative only, and not restrictive, and that many modifications may become apparent to those of ordinary skill in the art. For example, all dimensions discussed herein are provided as examples only, and are intended to be illustrative and not restrictive.

Any feature or element that is positively identified in this description may also be specifically excluded as a feature or element of an embodiment of the present as defined in the claims.

The disclosure described herein may be practiced in the absence of any element or elements, limitation or limitations, which is not specifically disclosed herein. The terms and expressions which have been employed are used as terms of description and not of limitation, and there is no intention in the use of such terms and expressions of excluding any equivalents of the features shown and described or portions thereof, but it is recognized that various modifications are possible within the scope of the disclosure.

The invention claimed is:

1. A room installation comprising:

a room comprising at least one wall, a ceiling, and a floor, each of which is at least partially covered by a mirrored surface;

at least one transparent window configured to permit ambient light into the room;

a first plurality of mirrored balloons arranged within the room, and filled with a mixture of helium and another gas, the mixture configured to float the mirrored balloons of the first plurality of mirrored balloons substantially within a middle height of the room; and a plurality of vents configured to circulate and move the mirrored balloons of the first plurality of mirrored balloons in a designated pattern within the room.

2. The room installation of claim 1, wherein at least one of the at least one wall, the ceiling, or the floor is entirely covered with mirrors.

3. The room installation of claim 1, wherein the at least one wall comprises two walls.

4. The room installation of claim 1, wherein the at least one wall comprises at least three walls.

5. The room installation of claim 1, wherein the plurality of vents comprises four vents.

6. The room installation of claim 1, wherein the designated pattern is a circular pattern.

7. The room installation of claim 1, wherein the designated pattern is a non-circular pattern.

8. The room installation of claim 1, further comprising:

a second plurality of mirrored balloons, wherein the mirrored balloons of the second plurality of mirrored balloons contact at least one the ceiling or the floor.

9. The room installation of claim 1, further comprising:

a second plurality of mirrored balloons, wherein the mirrored balloons of the second plurality of mirrored balloons contact the ceiling; and a third plurality of mirrored balloons, wherein the mirrored balloons of the third plurality of mirrored balloons contact the floor.

10. The room installation of claim 1, wherein the mirrored balloons of the first plurality of mirrored balloons float at at least two elevations within the room.

11. A system, comprising:

a room, comprising:

at least one wall at least partially covered with a mirrored surface, a ceiling at least partially covered with a mirrored surface, a floor at least partially covered with a mirrored surface, at least one window configured to allow light from outside of the room into the room, and at least one vent; and a first plurality of balloons, wherein each of the balloons of the first plurality of balloons is at least partially covered with a mirrored surface, wherein each of the balloons of the first plurality of balloons is positioned within the room, wherein each of the balloons of the first plurality of balloons contains a mixture of helium and another gas, such that each of the balloons of the first plurality of balloons floats at a middle height within the room out of contact with the ceiling and the floor, wherein the at least one vent is configured direct air toward at least one of the balloons of the first plurality of balloons to move the at least one of the balloons in a predetermined pattern.

12. The system of claim 11, wherein at least one of the at least one wall, the ceiling, or the floor is entirely covered with mirrors.

13. The system of claim 11, wherein the at least one wall comprises two walls.

14. The system of claim 11, wherein the at least one wall comprises at least three walls.

15. The system of claim 11, wherein the at least one vent comprises four vents.

16. The system of claim 11, wherein the predetermined pattern is a circular pattern.

17. The system of claim 11, wherein the predetermined pattern is a non-circular pattern.

18. The system of claim 11, further comprising:

a second plurality of balloons, wherein the balloons of the second plurality of balloons contact at least one the ceiling or the floor.

19. The system of claim 11, further comprising:

a second plurality of balloons, wherein the balloons of the second plurality of balloons contact the ceiling; and a third plurality of balloons, wherein the balloons of the third plurality of balloons contact the floor.

20. The system of claim 11, wherein the balloons of the first plurality of balloons float at at least two elevations within the room.

* * * * *